US009221478B2

(12) United States Patent
Braband

(10) Patent No.: US 9,221,478 B2
(45) Date of Patent: Dec. 29, 2015

(54) METHOD AND DEVICE FOR MONITORING TRAIN INTEGRITY

(75) Inventor: Jens Braband, Braunschweig (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 310 days.

(21) Appl. No.: 13/577,010

(22) PCT Filed: Jan. 27, 2011

(86) PCT No.: PCT/EP2011/051148

§ 371 (c)(1),
(2), (4) Date: Aug. 3, 2012

(87) PCT Pub. No.: WO2011/095429

PCT Pub. Date: Aug. 11, 2011

(65) Prior Publication Data

US 2012/0303188 A1 Nov. 29, 2012

(30) Foreign Application Priority Data

Feb. 3, 2010 (DE) ..... 10 2010 006 949

(51) Int. Cl.
*B61L 15/00* (2006.01)
*B61L 25/02* (2006.01)
*B61L 21/10* (2006.01)

(52) U.S. Cl.
CPC ..... *B61L 15/0054* (2013.01); *B61L 15/0027* (2013.01); *B61L 21/10* (2013.01); *B61L 25/021* (2013.01); *B61L 25/023* (2013.01)

(58) Field of Classification Search
CPC ... B61L 15/0054; B61L 25/021; B61L 21/10; B61L 25/023
USPC ..... 701/19; 246/6, 167 R, 168
See application file for complete search history.

(56) References Cited

U.S. PATENT DOCUMENTS 5,813,635 A * 9/1998 Fernandez ..... 246/168
2008/0105791 A1* 5/2008 Karg ..... 246/120

(Continued)

FOREIGN PATENT DOCUMENTS

CN 1562685 A 1/2005
CN 101327805 A 12/2008

(Continued)

OTHER PUBLICATIONS

Quante, F., et al., "Untersuchungen zur Zugvollständigkeitsüberwachung (ZVS) für Güterzüge", ETR Eisenbahntechnische Rundschau, Jul. 1, 2000, pp. 534-539, vol. 49, No. 7-8, Hestra-Verlag, Germany.

*Primary Examiner* — Calvin Cheung
*Assistant Examiner* — Thomas Ingram
(74) *Attorney, Agent, or Firm* — Laurence Greenberg; Werner Sterner; Ralph Locher

(57) ABSTRACT

A method and device for monitoring train integrity wherein train integrity modules—TIM—arranged in at least some of the cars of the train recognize shunting regions in accordance with a digital map. The TIMs exchange data upon exiting a first shunting region in a calibration phase and, based on predefined data stability criteria, recognize the affiliation thereof to the exiting train and the TIMs cyclically exchange sensor data, in particular in respect of velocity, position and travel direction, until entry into a second shunting region. The TIMs recognize a train separation on the basis of predefined logic criteria and optionally transmit the sensor data to an operating control center as applicable.

5 Claims, 1 Drawing Sheet

(56) References Cited

U.S. PATENT DOCUMENTS

| | | | | |
|---|---|---|---|---|
| 2008/0243320 | A1* | 10/2008 | Otsubo et al. | 701/19 |
| 2013/0284859 | A1* | 10/2013 | Polivka et al. | 246/34 R |

FOREIGN PATENT DOCUMENTS

| | | | |
|---|---|---|---|
| DE | 197 23 309 | A1 | 12/1998 |
| DE | 198 30 053 | C1 | 11/1999 |
| DE | 101 07 571 | A1 | 5/2002 |
| DE | 100 54 230 | C1 | 9/2002 |
| DE | 10 2004 057 907 | A1 | 6/2006 |
| DE | 10 2007 040 165 | A1 | 2/2009 |
| EP | 0970870 | A2 | 1/2000 |
| GB | 2 336 011 | A | 10/1999 |
| RU | 2240243 | C2 | 11/2004 |
| RU | 2008112050 | A | 10/2009 |
| WO | 2009/024563 | A1 | 2/2009 |

* cited by examiner

METHOD AND DEVICE FOR MONITORING TRAIN INTEGRITY

BACKGROUND OF THE INVENTION

Field of the Invention

The invention relates to a method and a device for monitoring train integrity. Train integrity is conventionally monitored by means of route-mounted axle counters or track circuits. In modern operating concepts, such as for example FFB—Funkfahrbetrieb [radio controlled operation]—or ETCS—European Train Control System—Level 3, efforts are made to move as many functions as possible, for example location determination, to the rail vehicle. The integrity of the train also has to be monitored on the vehicle side. However, this mainly relates to trains whose cars are frequently newly combined, i.e. in particular goods trains. In the case of multiple unit trains whose car sequence or train length is changed very rarely, the probability of separation of the train is generally so small that additional monitoring is not required.

In a known approach to a solution, a connection between the locomotive and the last car is used to determine the train integrity. This connection may be brought about, for example, electrically, pneumatically, in a radio-based fashion or optically. A special EOTD—End of Train Device—is frequently used. If the connection between the locomotive and the EOTD is ruptured, separation of the train is detected. In particular, the considerable expenditure, in particular for planning, is disadvantageous since explicit identification has to take place between the locomotive and the EOTD. Problems also arise with respect to inter-operability, loss and management.

Another approach to a solution is based on all the cars being equipped with a TIM—Train Integrity Module. These are modules which communicate with one another in a wireless fashion over short distances. The considerable expenditure which inter-operability problems entail is also disadvantageous here.

BRIEF SUMMARY OF THE INVENTION

The invention is based on the object of specifying a method and a device for monitoring train integrity, which is characterized by relatively low expenditure and improved reliability and availability.

According to the method, the object is achieved in that train integrity modules—TIMs—are arranged in at least some of the cars of the train, wherein the TIMs have a digital map with shunting regions, close-range communication means for the mutual exchange of data and long-range communication means for transmitting data to an operational control center and are connected to at least one sensor for detecting TIM-specific data, in particular the speed, position and direction of travel, cyclically up to the point of entry into a second shunting region, wherein the TIMs detect separation of the train on the basis of predefined logic criteria and, if appropriate, transmit the sensor data to an operational control center.

To this end, in accordance with the device, provision is made that train integrity modules—TIMs—are arranged in at least some of the cars of the train, wherein the TIMs have a digital map with shunting regions, close-range communication means for the mutual exchange of data and long-range communication means for transmitting data to an operational control center and are connected to at least one sensor for detecting TIM-specific data, in particular the speed, position and direction of travel.

Firstly, the TIMs are equipped with a digital map which contains the regions in which cars can be newly combined, i.e. the shunting regions. No particular requirements with respect to accuracy are made of this map; as it were a rough overview is sufficient. The train integrity is only monitored outside the shunting regions.

When exiting out of the shunting region occurs, firstly mutual identification of the TIMs which are present on the train in accordance with the car sequence takes place in a calibration phase. To do this, each TIM attempts to find the further TIMs located in its vicinity, during which process data are exchanged. Such data may be, for example, the speed and/or position and direction of travel which are determined by sensor and provided with a time stamp. These characteristics may be acquired by means of GNSS (Global Navigation Satellite System). On the basis of the stability of the received data during a planned time period, the TIMs which are located on the same train identify one another. If specific characteristics of the train are also exchanged, such as for example the speed, plausibility criteria for the mutual identification of the TIMs can be additionally or alternatively used. For example, the speed which is transmitted by the individual TIMs must correspond over the planned time period. Finally, the hypothesis that the identified TIMs are located in the same train results from formal model checking against a formal model of the train.

Subsequent to the short calibration phase, the actual monitoring for train integrity takes place by sensor data being cyclically exchanged between the TIMs.

In addition to the use of the speed as a comparison criterion, the distance between the individual TIMs which can be determined from the position and direction of travel is also advantageous. Threshold values are used here to determine the deviation, for example with respect to distance and/or speed, at and above which the hypothesis that the TIMs are located in the same train is infringed. All that is necessary is formal verification of the validity or non-validity of the train integrity hypothesis.

When the hypothesis is infringed, each TIM which has detected the infringement signals this detected train separation to the operational control center. The affected train is detected in the operational control center on the basis of the position signaling of the TIMs or of the train, with the result that suitable operational measures can be initiated without delay.

Particular robustness with respect to individual or else multiple failures of TIMs can be achieved by virtue of the fact that redundancies and pluasibilities are taken into account. For example, the failure of an adjacent TIM can be ignored if a TIM which is further away in the same direction is still detected.

On entry into the next shunting region, the monitoring of the train integrity on the basis of the map information is suspended and is initialized again with renewed calibration after this shunting region is exited.

According to the claimed invention the TIMs form corresponding clusters in the calibration phase of their data range. Overlapping clusters, resulting in single or even multiple redundancy, are particularly advantageous.

The method can also be configured more robustly if, according to the claimed invention, the TIMs pass on sensor data received from first TIMs to second TIMs. This results, as it were, in a global picture of the train, with the result that it is possible to determine which TIM is the first TIM and which is the last TIM in the direction of travel. The checking conditions for the monitoring of the train integrity can be simplified by this but at the same time the method becomes more complex and the communication overheads increase.

The device for carrying out the method can be embodied particularly advantageously according to the claimed invention by virtue of the fact that the TIMs are embodied as wireless modules which are planned in accordance with the method and are provided per se for other functionalities. For example, the VICOS CT modules from Siemens, which are primarily provided for optimizing operational control, are suitable for this. These modules are, as it were, used in an unintended way or additionally for monitoring the train integrity. The GNSS locating system which is already present and the mobile radio link to the operational control center and the local close-range wireless connection are used for the TIM function, wherein the digital map is additionally planned and the TIM function is initially configured. The train integrity is subsequently monitored autonomously. Software updates or map updates can be implemented over the existing mobile radio link.

Although it would be desirable operationally to arrange a car which is equipped with a TIM as far as possible at the start and at the end of the train to be monitored during the shunting process, but also in the event that this is not possible, at least partial monitoring takes place as a function of the TIM equipment level of the train. In this context, in the double-use variant as claimed it can be assumed that a large percentage, for example 20 to 30% of a fleet of cars is already equipped with wireless modules, wherein the TIM functionality would lead to a further increase in the equipment level.

The invention will be explained in more detail below with reference to figurative illustrations, in which,

DESCRIPTION OF THE INVENTION

Figure 1:
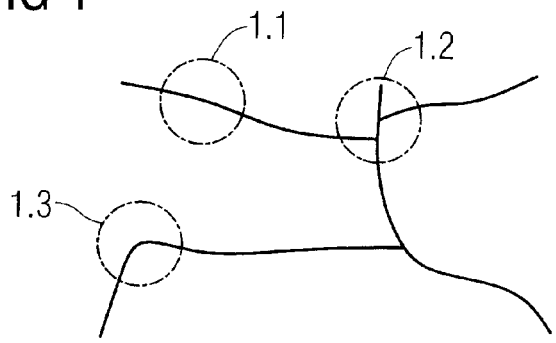
FIG. 1 shows a map illustration with shunting regions.

FIG. 1 shows by way of example a map diagram of routes with shunting regions 1.1, 1.2, 1.3 which are saved in as far as possible an already existing wireless module in order to retrofit said module to form a train integrity module—TIM—2.1, 2.2, 2.3, 2.4. The TIM 2.1, 2.2, 2.3, 2.4 is also equipped with initialization software, as a result of which autonomous monitoring of the train integrity is made possible. For this purpose, a calibration phase is planned, in which, immediately after the exiting from a shunting region 1.1, 1.2, 1.3, an exchange of data takes place between the TIMs 2.1, 2.2, 2.3, 2.4 which are distributed on a train-internal basis in accordance with the car sequence which occurred in the shunting region 1.1, 1.2 or 1.3. By means of this first exchange of data, the TIMs 2.1, 2.2, 2.3, 2.4 detect their association with the departing train 3. Data relating to the speed 4, position and direction of travel, provided with time stamps, is preferably exchanged. The TIMs 2.1, 2.2, 2.3, 2.4 determine their mutual distance 5 from the position data and direction of travel data. The data may be determined, for example, by means of GNSS—Global Navigation Satellite System—receivers.

Figure 2:
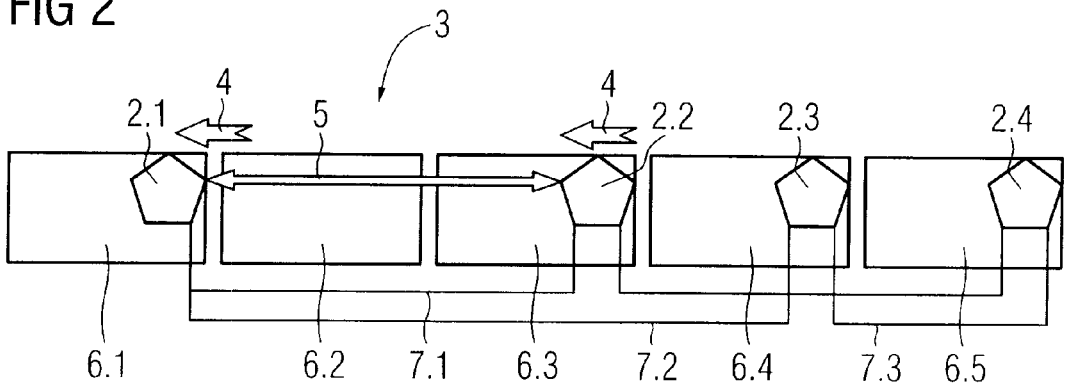
FIG. 2 shows a train configuration with modules for monitoring the train integrity.

In the exemplary embodiment according to FIG. 2, five cars 6.1 to 6.5 are configured to form the train 3 in the shunting region 1.1, 1.2 or 1.3. The first car 6.1 may be the locomotive of the train 3 here. It is apparent that the cars 6.1, 6.3, 6.4 and 6.5 are each equipped with a TIM 2.1, 2.2, 2.3 and 2.4, respectively, and that the car 6.2 does not have a TIM. Depending on the range of their close-range communication means, the TIMs 2.1, 2.2, 2.3 and 2.4 form clusters 7.1, 7.2 and 7.3 in the calibration phase. The clusters 7.1, 7.2 and 7.3 can overlap here, with the result that the communication chain is not ruptured even if one or more TIMs 2.1, 2.2, 2.3, 2.4 fail.

After the TIMs 2.1, 2.2, 2.3, 2.4 have identified each other as being associated with the train 3 on the basis of continuous data stability in the calibration phase, the actual monitoring of the train integrity begins. In this case, measurement data relating to the speed 4 and distance data 5 derived from the measurement data relating to the position and direction of travel are exchanged and evaluated on the basis of plausibility criteria. In this way it is detected if, for example, the TIM 2.4 in the last car 6.5 of the train 3 has, owing to separation of this car 6.5, a relatively low speed 4 as the distance 5 from the adjacent TIM 2.3 increases. In this case, at least the TIM 2.3 which has detected this dangerous state signals at least its own position data to an operational control center. A mobile radio link is used for this long-range communication, while preferably a WLAN link is used for the short-range communication between the TIMs 2.1, 2.2, 2.3 and 2.4.

The invention claimed is:

1. A method of monitoring an integrity of a train having a plurality of cars, the method which comprises:

providing train integrity modules (TIMs) in at least some of the cars of the train, and detecting with the TIMs shunting regions by way of a digital map;

on exiting from a first shunting region, exchanging data between the TIMs in a calibration phase, and detecting an association with a train traveling away from the first shunting region on a basis of predefined data stability criteria;

acquiring with the TIMs sensor data including a speed of travel and a position;

cyclically exchanging, via close-range communication, the sensor data between the TIMs up to a point of entry into a second shunting region, and detecting with the TIMs a separation of the train on a basis of predefined logic criteria and, if appropriate, transmitting the sensor data from the TIMs to an operational control center via long-range communication.

2. The method according to claim 1, wherein the sensor data being exchanged are selected from the group consisting of data relating to a speed, a position and a direction of travel.

3. The method according to claim 1, wherein, in the calibration phase, the TIMs form clusters corresponding to their data range.

4. The method according to claim 1, which comprises passing on with the TIMs sensor data received from a first TIM to a second TIM.

5. A device for monitoring an integrity of a train having a plurality of cars, the device comprising:

train integrity modules (TIMs) disposed in at least some of the cars of the train, said TIMs containing a digital map with shunting regions;

close-range communication devices configured for exchanging data between the TIMs and long-range communication devices configured for transmitting data to an operational control center; and at least one sensor configured for detecting TIM-specific data including a speed, a position, and a direction of travel;

said TIMs being configured, on exiting from a first shunting region, to exchange data in a calibration phase and to determine an association with a train exiting from the first shunting region on a basis of predefined data stability criteria;

said TIMs being further configured to cyclically exchange, via said close-range communication devices, sensor data up to a point of entry into a second shunting region, and to detect a separation of the train on a basis of predefined logic criteria and, if appropriate, to transmit the sensor data to an operational control center via said long-range communication devices.

* * * * *